United States Patent [19]

Färber et al.

[11] 4,034,422

[45] July 12, 1977

[54] DEVICE FOR DISPOSAL OF MATERIALS, PARTICULARLY OF HOUSEHOLD AND KITCHEN WASTE

[75] Inventors: Karlheinz Färber; Rolf Mayer; Alexander Rupp, all of Giengen, Germany

[73] Assignee: Bosch-Siemens Hausgerate GmbH, Stuttgart, Germany

[21] Appl. No.: 653,033

[22] Filed: Jan. 28, 1976

[30] Foreign Application Priority Data

Feb. 1, 1975 Germany ..... 2504164

[51] Int. Cl.[2] ..... E03C 1/18; B02C 4/32; B02C 7/14; B02C 9/04

[52] U.S. Cl. ..... 4/187 R; 4/DIG. 4; 241/33; 241/36; 241/46 A

[58] Field of Search ..... 4/187 R, DIG. 4, 10; 241/33, 36, 46 A, 100.5

[56] References Cited

U.S. PATENT DOCUMENTS

| | | | |
|---|---|---|---|
| 2,220,729 | 11/1940 | Powers | 4/187 X |
| 2,244,402 | 6/1941 | Powers | 241/36 X |
| 2,536,372 | 1/1951 | Jordan | 4/187 |
| 2,742,236 | 4/1956 | Sutton | 241/36 |
| 2,979,274 | 4/1961 | Tull | 241/32.5 |
| 3,071,424 | 1/1963 | Butter | 4/187 R X |

*Primary Examiner*—Henry K. Artis
*Attorney, Agent, or Firm*—Herbert L. Lerner

[57] ABSTRACT

A waste disposal device includes a receptacle for holding liquid and waste materials, a liquid drainline secured to the receptacle, a collecting tank connected in the drainline to collect the liquid and waste materials from the receptacle, a waste disintegrator extending into the collecting tank, drive means for operating the waste disintegrator, and control means in the drainline for actuating the drive means upon collection of liquid over a given level in the collecting tank and upon the flow of the liquid out of the tank through the drainline. The waste disintegrator is a rotatable impact knife, the drive means is a motor coupled to the knife, and the control means includes a siphon tube directing the flow of the liquid over a given level out of the tank, and pressure sensitive switching means for sensing a change in pressure in the siphon tube upon the occurrence of the flow of liquid to actuate the motor.

15 Claims, 2 Drawing Figures

DEVICE FOR DISPOSAL OF MATERIALS, PARTICULARLY OF HOUSEHOLD AND KITCHEN WASTE

BACKGROUND OF THE INVENTION

1. Field of the Invention

This invention relates to a device for the disposal of materials, such as household and kitchen waste, by size reduction, or grinding, and flushing into a drain line, with a waste disintegrator operating below the liquid supply line, the disintegrating element preferably using a rotating impact-knife which is intermittently driven by a drive motor.

2. Description of the Prior Art

In known devices of this kind, particularly in those used for the disposal of kitchen and household wastes, it is customary to start the waste disintegrator by depending and/or rotating a safety plug disposed in the filler opening and similarly to stop the device by releasing the safety plug respectively by further depressing and/or rotating the safety plug. An abundant water supply is therefore required to simultaneously assure satisfactory size reduction or grinding action and to flush the cut up waste through the drain pipe in order to avoid obstruction or clogging of the waste disintegrator. Particularly in using such devices in the household, the required water is taken as fresh water from the water supply system, so that the person operating the waste disintegrator or garbage disposal must simultaneously operate the water admission valve and the switch mechanism for the waste disintegrator.

This is very unsatisfactory because the known devices require continuous supervision during their operation. Otherwise, large energy losses as well as water losses occur if the waste disintegrator and the required water supply are not shut off at the right time. Furthermore, it has been shown as a disadvantage, even with most careful operation, that the large quantities of fresh water which are required for the operation of the known devices greatly increase the cost of waste disposals. As another disadvantage, it has been shown that the required abundant use of water considerably increases the load on the water drainage system and can cause failure of the drainage system.

It also has been suggested that, to relieve the drainage system, the wastes should be stored in tanks or containers which are connected to the drainage system, and the emptying of the tanks into the drainage system should be made dependent upon time or be controlled by a central command either singly or in groups. Such a solution is not only complicated but also causes considerable problems with respect to space because of the necessity of storing the wastes for a certain time and in general does not avoid the very high water consumption.

SUMMARY OF THE INVENTION

It is therefore the primary object of the invention of the present application to overcome these disadvantages and to make the operation of such devices easier and independent of supervision by an operator while also reducing the energy and water consumption. The simplified system reduces the costs of operating such a device and also avoids an excessive loading of the drainage system.

This object is achieved by controlling the drive motor of the waste disintegrator with a switching element which responds to the liquid level of a liquid storage tank coupled to the waste disintegrator and disposed in the drainage line.

It is thereby possible to operate the waste disintegrator automatically without close supervision and to reuse previously used water instead of fresh water which otherwise is discharged uselessly through the drainage line into the water drainage system. By making control of the device motor dependent upon the filling liquid level of the liquid storage tank, possible operating difficulties and damage that may be caused by dry running of the waste disintergrator are positively avoided.

With the foregoing and other objects in view there is provided in accordance with the invention, a waste disposal device which includes a receptacle for holding liquid and waste materials, a liquid drainline secured to the receptacle, a collecting tank connected in the drainline to collect the liquid and waste materials from the receptacle, a waste disintegrator extending into the collecting tank, drive means for operating the waste disintegrator, and control means in the drainline for actuating the drive means upon collection of liquid over a given level in the collecting tank and upon the flow of the liquid out of the tank through the drainline. The waste disintegrator is a rotatable impact knife, the drive means is a motor coupled to the knife, and the control means includes a siphon tube directing the flow of the liquid over a given level out of the tank, and pressure sensitive switching means for sensing a change in pressure in the siphon tube upon the occurrence of the flow of liquid to actuate the motor.

In accordance with another features of the invention, the waste disintegrator, collecting tank, drive means, control means and drainline disposed in a common housing under the receptacle, the rotatable knife extending into the bottom of the collecting tank.

In accordance with a further feature of the invention, the knife is spaced above the bottom of the collecting tank.

In accordance with a still further feature of the invention, the syphon tube includes an inlet suction portion and an outer portion, the switching means being disposed at one of the portions.

In accordance with an additional feature of the invention, the collecting tank includes an opening adjacent the rotatable knife providing access to the knife, and a cover closing the opening.

Yet another feature of the invention is a strainer dividing the collecting tank into two chambers, one chamber including the impact knife, and the other chamber including the siphon tube.

As another added feature of the invention, the strainer is slanted so that the bottom of the strainer is spaced further from the axis of rotation of the knife than the top of the strainer.

A further feature of the invention, is a liquid overflow means connected to the other chamber.

A still further feature of the invention is an air ventilating means connected to the overflow means.

Another feature of the invention is an odor trap in the drainline; and

One further feature of the invention is a torque limiting means in the drive motor to prevent overload of the motor.

Other features which are considered as characteristic for the invention are set forth in the appended claims.

Although the invention is illustrated and described herein as embodied in a device for disposal of materials, particularly of household and kitchen waste, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
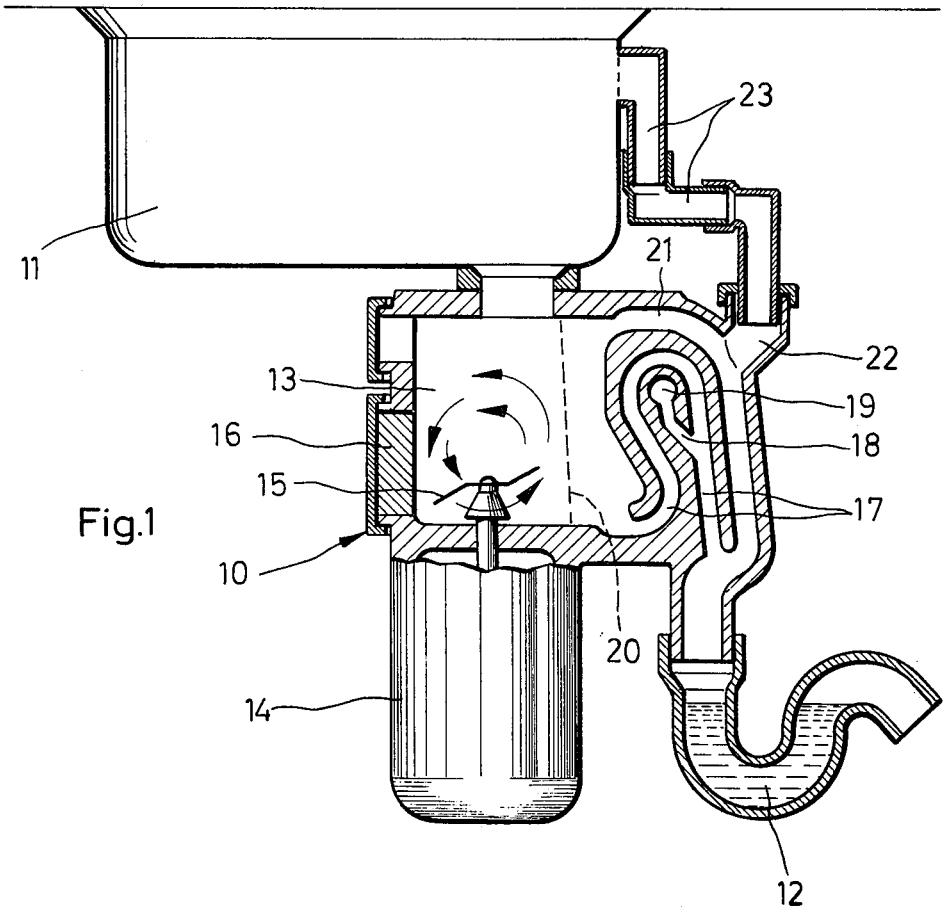
FIG. 1 is a side elevational view, partly in cross-section of one embodiment of the waste disposal device of the present invention which is attached under a kitchen sink.

As shown in FIG. 1 a device 10 for the disposal of house and kitchen wastes is mounted under a kitchen sink 11 and is connected to the oder trap 12 of the drainpipe. The device 10 has a collecting tank 13 or reservoir which is constructed as a single unit with a waste disintegrator 14 and is provided with a rotating impact knife 15 which is disposed above the bottom of the tank 13. The impact knife 15 is arranged eccentrically with reference to the bottom of the tank and is so bent or pitched that it generates a motion, as shown by the direction of the arrows, in the liquid stored in the tank 13 whenever its drive is activated. The rotating impact knife 15, which serves as cutting element of the waste disintegrator 14, is provided with torque limiting features, not shown. This may be, for example, in the form of a slip clutch or transmission member provided with a known type of shear pin 25, as shown schematically in FIG. 2. The impacting knife 15 is made accessible by a service opening in the front wall of the collecting tank 13 which opening is closed by a cover 16.

In the side of the tank 13 opposite the cover 16 is siphon 17, arranged with a descending suction tube which effects the discharge of the collecting tank 13. A branch tube 18 is attached to the descending tube of siphon 17, with a switching element 19, activated by a fluid pressure transducer, disposed at its end. This pressure sensitive switching element 19 of a suitably known type, electrically activates the drive motor of the waste disintegrator 14 in accordance with the suction caused by the liquid passing through the descendent tube of the siphon 17 and thereby keeps the drive motor energized during the passage of liquid through the tube. The switching element 19 may, for example, include an electrical switching device linked to a diaphragm, so that a change of air or liquid pressure of a given amount moves the diaphragm to close the switch and actuate the circuit and motor. The siphon 17 is preceded by a stainer 20 which divides the inner space of the collecting tank 13 into two chambers, one associated with the rotating impact knife 15 of the waste disintegrator and the other associated with siphon 17. The strainer is arranged in a slanted position, so that its distance from the axis of rotating impact knife 15 is greater at the bottom of the collecting tank 13 than in the upper part of the tank. The chamber of tank 13 associated with siphon 17 is furnished with an overflow line 21 to which is attached an air release tube 22 connected to the overflow duct or tube 23 of the sink.

Figure 2:
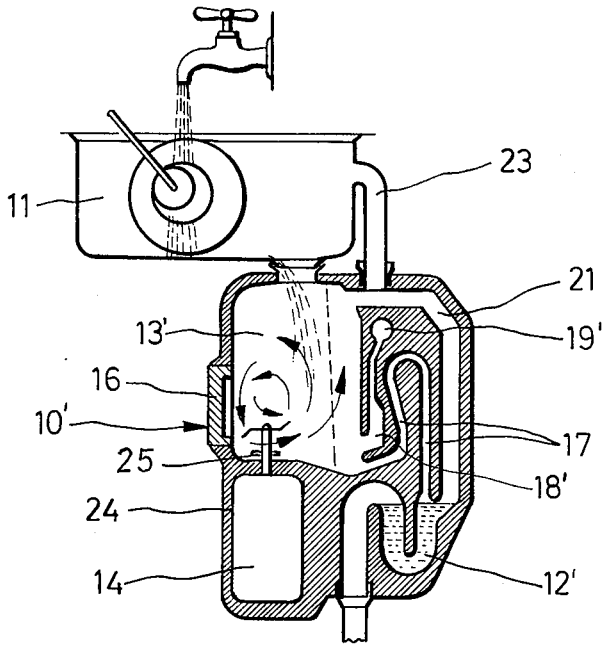
FIG. 2 is a side elevational view partly in cross-section of a second embodiment of the waste disposal device mounted under the sink.

The embodiment shown in FIG. 2, in which equivalent parts utilize the same reference numerals, differs from the preceding embodiment mainly in a branch line 18' which leads directly into the collecting tank 13' rather than into siphon 17. At the end of this branch line 18' is disposed a switching element 19' which, for example, can also be a pressure sensitive switch. A further difference from the embodiment of FIG. 1 is that in this embodiment, the housing 24 encloses both the collecting tank 13' as well as the waste disintegrator 14 and also contains the odor trap 12' for the drain pipe.

The above described arrangements operate in the following manner: During the washing of dishes, washing and peeling of potatoes, cleaning and washing vegetables, etc., food leftovers and wastes are flushed with the rinse and wash water from sink 11 into the collecting tank 13 which is located beneath it. This collecting tank 13 eventually fills until the level of the used collected water rises above the top point or apex siphon 17. The overflowing siphon 17 now starts to empty collecting tank 13 by suction due to the generated lower pressure in the descending tube 17 so that, in the embodiment of FIG. 1, an underpressure is generated in the dead or blind end of branch line 18 which communicates with the descending tube of siphon 17. This underpressure causes switching element 19 to energize the drive motor of the waste disintegrator 14. The flow of water is generated by impact knife 15 which rotates at a high speed, as indicated by arrows in both figures. Thereby, the water rapidly carries the waste materials along and brings them within the reach of the rotating impact knife 15. Due to the circulatory flow, the materials repeatedly come in contact with the impact knife and are quickly reduced in size. The fragmented wastes pass through the openings of the hold back strainer 20 into the part of the tank which is associated with siphon 17 and are discharged with the liquid running through the siphon 17, so that they reach the drain pipe through odor trap 12. As soon as the water is run off from collecting tank 13 and air enters into the suction tube of siphon 17, the flow in siphon 17 stops. The normal pressure is thereby restored in the descending tube of siphon 17 and the branch line 18 connected therewith. The switching element 19 is then opened and the drive motor of the waste disintegrator and its rotating impact knife remain inactive until the liquid level in the collecting tank 13 has again risen above the height of the top point of siphon 17. Overflow of the siphon then initiates a new cycle of the waste disintegrator.

The turbulence of the water by the rotating impact knife in collecting tank 13 causes the hold-back strainer 20 which precedes siphon 17, to be cleaned automatically by the resulting strong current and thereby avoids clogging. The slanted position of the strainer 20 facilitates the sliding of the wastes which fill tank 13. The ventilating tube or line 22 has the purpose of avoiding a back suction on siphon 17 which could prevent the pressure-sensitive switching element 19 from turning off.

In order to avoid generating an underpressure or negative pressure in the collecting tank 13 when the drain of the basin 11 is closed and to assure trouble-free discharge of the collecting tank, the tank is ventilated by overflow line 21 and vent line 22. The overflow line 21 also serves to prevent the overflow of collecting tank 13.

If the waste disintegrator is improperly used by insertion of waste that is not suited for reduction, or to avoid damaging of objects which get unintentionally into the waste disintegrator, the impact knife is connected to the drive with a slip clutch or a power transmission member, such as a shear pin, having a purposely weakened section which breaks at overload. Thereby, the rotating knife stops instantly when objects that are hard or cannot be cut get into the reach of the rotating impact knife. Through the service window in the front side of the collecting tank, which is closed by cover 16, a damaged knife can readily be exchanged and a part which unintentionally got into the collecting tank 13 can be removed therefrom. The arrangement of the rotating impact knife above the bottom of the collecting tank 13 has the advantage that heavy objects which unintentionally get into the collecting tank, for example, table flatware etc., sink to the bottom of the collecting tank and because of their weight are not pulled along by the flow and do not get into the reach of the rotating impact knife.

The partition of the inner space of the collecting tank by the hold-back strainer 20 and particularly the size of the chamber associated with the siphon 17 determines the cycle time of the device. When the strainer is partly clogged by retained wastes which are not sufficiently reduced and therefore present a large flow resistance to the water coming from the chamber with the rotating impace knife, the flow in the siphon stops before the chamber associated with the rotating impact knife 15 is completely emptied. However, this is not disadvantage because the waste disintegrator will immediately start to run again when the liquid level from inflowing water passes over the top point of siphon 17 and the ressulting strong turbulence of the water causes automatic self-cleaning of the hold-back strainer.

In the embodiment of FIG. 2, branch line 18′ is in direct connection with the collecting tank 13′. The pressure switch 19′ which is disposed at the end of this branch line is so positioned that it turns on the drive motor of the waste disintegrator activated by the pressure existing in the collecting tank 13′, before the liquid level in the collecting tank has passed the height of the top point of the siphon 17.

Activation of the pressure switch 19 creates a strong water turbulence which generates a water surge that causes the siphon 17 to overflow and thereby initiates the discharge of collecting tank 13′. In the embodiment of FIG. 2, the waste disintegrator is thus also set in motion when the water flow from the sink 11 is very low, but the liquid level in the collecting tank has reached the required height.

That is not the case in the embodiment of FIG. 1, since siphon 17 serves only as an overflow for collecting tank 13 when the water flow is small. This has the advantage that the waste disintegrator cannot be started unintentionally, for example by inflowing water from a dripping faucet, because a large amount of water has to be added at a time in order to start the device. Obviously, this effect can be also achieved with the embodiment of FIG. 2. In this case, it is only necessary to set the switching point of pressure switch 19′ to a value which corresponds to a water level above the top point of the siphon.

An important feature is that the described device automatically starts without supervision when the level of the water collected in tank 13 exceeds the height of the top point of the siphon 17 and is immediately stopped when the flow in siphon 17 is interrupted by entering air at the lower end of the siphon. A particular advantage of the present device in comparison to known waste disintegrators can be seen in the fact that it requires no fresh water and can employ only previously used rinse or washwater which otherwise flows uselessly through the drain pipe.

There are claimed:

1. A waste disposal device comprising:
a receptacle for holding liquid and waste material;
a liquid drainline secured to said receptacle;
a collecting tank connected in said drainline to collect said liquid and waste materials from said receptacle;
a waste disintegrator extending into said collecting tank;
drive means for operating said waste disintegrator; and
control means in said drainline for actuating said drive means upon collection of liquid over a given level in said collecting tank and upon the flow of said liquid out of said tank through said drainline, said control means including pressure sensitive switching means for sensing a change in pressure in said drainline upon the occurence of said flow of liquid to actuate said motor.

2. The device of claim 1 wherein said waste disintegrator is a rotatable impact knife; said drive means being a motor coupled to said knife; and said control means further includes a siphon tube connected in said drianline for directing the flow of said liquid over a given level out of said tank, said pressure sensitive switching means sensing said change in pressure in said siphon tube.

3. The device of claim 2 wherein said waste disintegrator, collecting tank, drive means, control means and drainline are disposed in a common housing under said receptacle, said rotatable knife extending into the bottom of said collecting tank.

4. The device of claim 3 wherein said knife is spaced above the bottom of said collecting tank.

5. The device of claim 4 wherein said siphon tube includes an inlet suction portion and an outlet portion, said switching means being disposed at one of said portions.

6. The device of claim 5 wherein said switching means is disposed in said inlet suction portion.

7. The device of claim 5 wherein said switching means is disposed in said outlet portion.

8. The device of claim 5 including an opening in said collecting tank adjacent said rotatable knife providing access to said knife and a cover closing said opening.

9. The device of claim 5 including a strainer dividing said collecting tank into two chambers, one chamber including said impact knife and the other chamber including said siphon tube.

10. The device of claim 9 wherein said strainer is slanted so that the bottom of said strainer is spaced further from the axis of rotation of said knife than the top of said strainer.

11. The device of claim 9 including liquid overflow means connected to said other chamber.

12. The device of claim 11 including air ventilating means connected to said overflow means.

13. The device of claim 9 wherein said receptacle for holding liquid and waste materials is a water basin.

14. The device of claim 13 wherein said drainline includes an ordor trap.

15. The device of claim 9 wherein said drive motor includes torque limiting means to prevent overload of said motor.

* * * * *